United States Patent [19]

Sekiguchi et al.

[11] 4,083,178

[45] Apr. 11, 1978

[54] WATCH CASE

[75] Inventors: Tsunetoshi Sekiguchi, Sayama; Tsutomu Noguchi, Tokyo, both of Japan

[73] Assignee: Citizen Watch Co. Ltd., Tokyo, Japan

[21] Appl. No.: 725,560

[22] Filed: Sep. 22, 1976

[51] Int. Cl.[2] ..... G04B 37/00; G04B 39/00

[52] U.S. Cl. ..... 58/88 R; 58/53; 58/91

[58] Field of Search ..... 58/53–56, 58/57, 88 R, 90 R, 91, 101, 102; 73/273, 431

[56] References Cited

U.S. PATENT DOCUMENTS

| | | | |
|---|---|---|---|
| 2,845,773 | 8/1974 | Sakalys | 58/90 R |
| 3,264,820 | 8/1966 | Piquerez | 58/90 R |
| 3,782,105 | 1/1974 | Nozawa | 58/90 R |

*Primary Examiner*—Edith S. Jackmon

*Attorney, Agent, or Firm*—Sherman & Shalloway

[57] ABSTRACT

A watch case including external and internal case bands, crystal, and flexible packing wherein provision is made of a horizontal groove for a leaf spring and vertical groove for a lever and thereby being easily assembled and disassembled by means of the lever.

8 Claims, 10 Drawing Figures

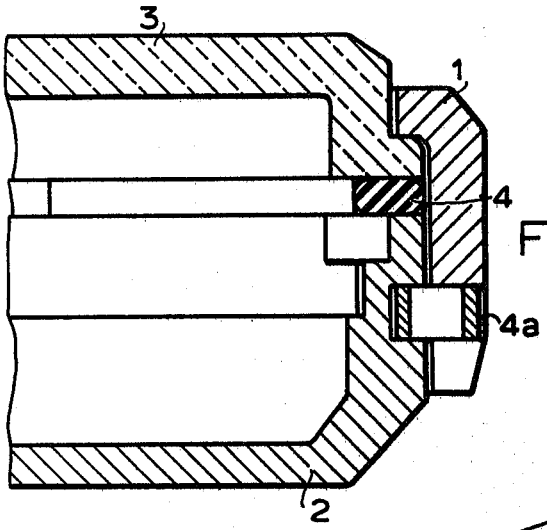
FIG. 1 (PRIOR ART)
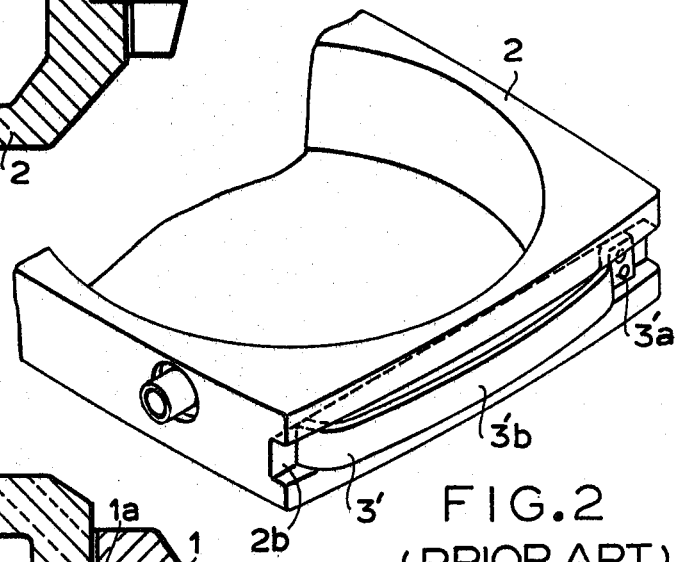
FIG. 2 (PRIOR ART)
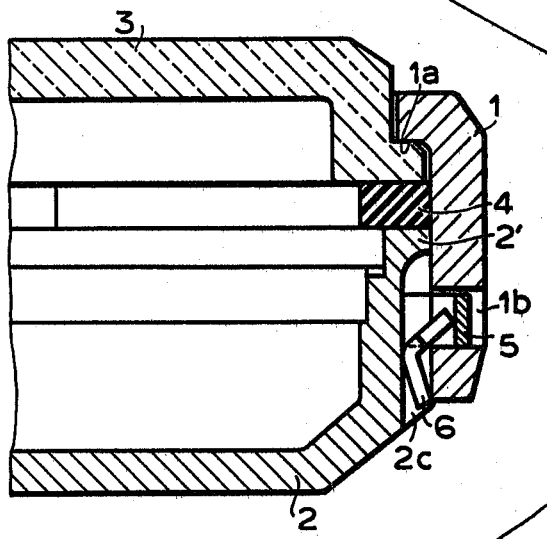
FIG. 3
FIG. 4
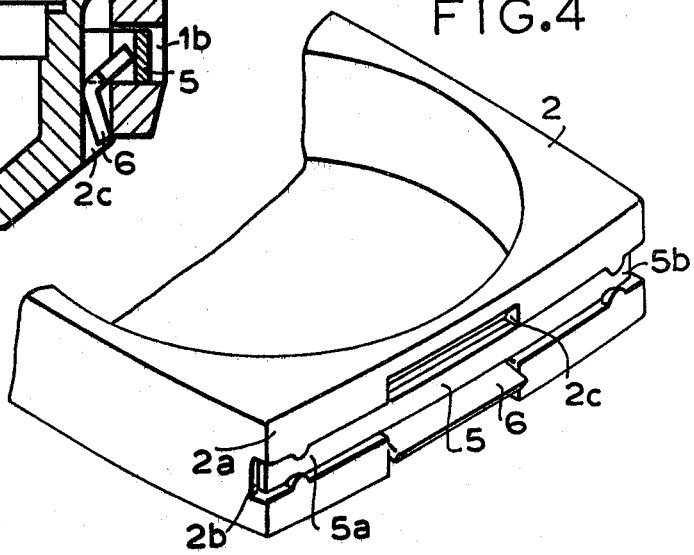

WATCH CASE

BACKGROUND OF THE INVENTION

1. FIELD OF THE INVENTION

This invention relates to a waterproof watch case in which a crystal and case bands are assembled and disassembled in ease by means of a lever member.

2. DESCRIPTION OF THE PRIOR ART

Heretofore proposed are waterproof watches in which one end of a leaf spring or wire-shaped spring is fixed to the interior of a horizontal groove formed at an internal case band and the remaining portion of the spring is extruded from the horizontal groove. Such a conventional watch will be described in detail with reference to FIGS. 1 and 2 in the accompanying drawings.

A spring member 3' being arch-shaped in plan view or provided with a projection at a central portion is fitted to a groove **2*b* formed arround the outer periphery of the internal case band 2. One end of the spring member 3'*a* is secured to the inner wall of the groove 2*b* by welding or calking method. The central portion 3'*b* of the spring member 3' is protruded at the exterior from the outer periphery of the internal case band 2. When the external case band 1 is assembled with the internal case band 2, the central portion 3'*b* may be engaged with a long through hole 4*a* of the external case band 1 such that the central portion is compulsorily inserted into the groove 2*b*** of the outer periphery by means of a screwdriver, etc. Therefore, extremely careful attention should be paid in assembling process for preventing one of the springs from being unfastened unless the outer case band the inner case band are kept in parallel.

In this case, the extrusion of the spring is depressed inside to be engaged with the groove when the internal case band is engaged with the external case band. Therefore, this kind of the conventional watches are inferior in assembling. Namely, it is difficult for those to be assembled or disassembled and those are unsteady in water-proof characteristics.

SUMMARY OF THE INVENTION

Accordingly, an object of the present invention is to provide an improved waterproof watch case wherein the above-mentioned disadvantages are obviated.

Another object of the present invention is to provide a waterproof watch case easy to be assembled or disassembled.

Further another object of the present invention is to provide a waterproof watch case, of which the waterproof characteristics are very excellent.

Furthermore another object of the present invention is to provide a waterproof watch case, of which a lever for assembling or disassembling a watch is easily manufactured and low in cost.

According to an aspect of the present invention, a waterproof watch case includes an external case band, internal case band, crystal and a flexible packing sandwiched between the upper surface of the peripheral flange at said internal case band and the lower surface of the peripheral flange at said windshield wherein said watch case comprises a horizontal groove into which a leaf spring is inserted and a vertical groove into which a lever is inserted, said grooves being provided on said internal case band, and a hole with which said leaf spring is engaged being provided on said external groove.

According to another aspect of the present invention, a watch case has the operating point of the lever existing within the vertical groove and on the back side of the leaf spring.

According to a further aspect of the present invention, a watch case has at least one end of the leaf spring being slidably mounted on the external case band by calking in press method.

According to a still further aspect of the present invention, a watch case has the crystal of a glass plate and a ring.

According to a still other aspect of the present invention, a watch case has an arm of the lever being arranged in the horizontal groove of the internal case band.

According to a still other aspect of the present invention, a watch case has a long blind hole engaged with the leaf spring provided at the inside, and a cut-away portion or hole formed at the bottom of the long blind hole to compulsorily insert the leaf spring therein.

According to a still other aspect of the present invention, a watch case has a foot of the lever protruding internally from a side wall of the internal case band when the foot is not engaged with the external case band.

According to a still other aspect of the present invention, a watch case had the lever being positioned internally from the side wall of the internal case band when the leaf spring is not engaged with the external case band.

According to a still other aspect of the present invention, a watch case has the lower surface portion of the external case band being engaged with the foot of the lever and thereby the leaf spring being compulsorily protruded at the upper portion of the lever.

Further other objects, features and advantages of the invention will be apparent from the following more particular description of preferred embodiments of the invention as illustrated in the accompanying drawings.

BRIEF DESCRIPTION OF THE DRAWINGS

FIG. 1 is a partially vertical section of a conventional waterproof watch case being assembled;

FIG. 2 is a partially perspective view showing a brief part of FIG. 1;

FIG. 3 is a partially vertical section showing an embodiment of an assembled waterproof watch case according to this invention;

FIG. 4 is a partially perspective view showing an internal case band of FIG. 3;

DETAILED DESCRIPTION OF PREFERRED EMBODIMENTS

Figure 5:
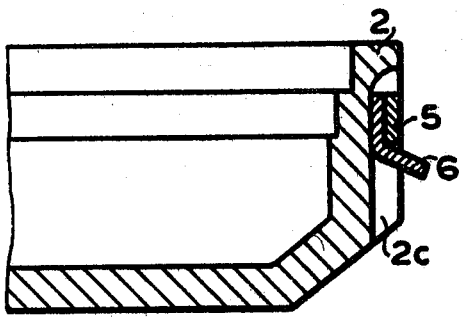
FIG. 5 is a partially vertical section showing the internal case band of FIG. 3.

In FIGS. 3, 4, 5, shown is a rectangle-shaped waterproof watch case of one embodiment according to the present invention wherein reference numeral 1 depicts an external case band, by which an internal case band 2 and crystal 3 are enclosed a flexible packing 4 is interposed between the upper surface of a flange 2' of the internal case band 2 and the lower surface of a flange 1*a* of the windshield 3. On a side wall 2*a* opposite to the internal case band 2, a vertical groove 2*c* is formed traversely to a longitudinal groove 2*b*. The vertical groove 2*c* does not reach the upper surface of the internal case band 2. Reference numeral 5 illustrates a leaf spring which is not required to be bent in manufacture and at least one of both ends 5*a*, 5*b* of the leaf spring 5 is supported in said groove 2*b* by press-manufacture and the like such that the leaf spring 5 is slidable along said groove 2*b* in lateral direction. In this case, the central portion of the leaf spring 5 is enclosed in the longitudinal groove 2*b* and is not protruded from the periphery of the internal case band 2 like both the end portions of the leaf spring 5.

The external case band 1 is provided with the flange 1*a* for supporting the windshield 3. A long through hole 1*b* is formed on the wall opposite to the longitudinal groove 2*b* of the internal case band 2 and is arranged at such a position that the leaf spring 5 is engaged to depress the flexible packing 4 when the internal case band 2 is assembled into the external case band 1.

Figure 6:
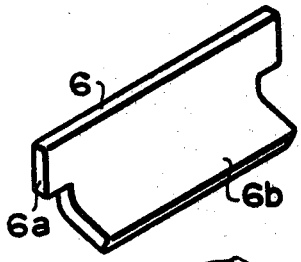
FIG. 6 is a perspective view showing a lever of FIG. 3.

Reference numeral 6 designates a bent lever which is inserted into the vertical groove 2*c* and the detail of the lever is shown in FIG. 6. The lever 6 is engaged with the horizontal groove 2*b* so as not to break away from the case bands 1,2. The lever 6 is provided with an arm 6*a* for pressing the leaf spring 6 in external direction and a foot 6*b* inserted in the vertical groove 2*c*. Further, the lever 6 is inserted between the space of the horizontal and vertical grooves 2*b*, 2*c* and the internal side of leaf spring 5 facing side 2*a*.

Described will be the assembling of the internal and external bands 1,2.

Initially a watch movement (not shown) including a dial is accommodated in the internal band 2, and the crystal 3 is mounted on the internal band 2 through the flexible packing 4. Next, the external band 1 is engaged with the internal band 2 and manual depression on the upper portion of the external band 1 causes the depression of the foot 6*b* of the lever 6 and at the same time, pressing the leaf spring 5 outwardly by means of the arm 6*a* of the lever so as to make the leaf spring 5 engage with the long through hole 1*b* of the external band 1.

Since the lever 6 has a suitable flexibility, the leaf spring 5 is engaged with the long through hole 1*b* of the external band 1 in good timing.

On the other hand, it is sufficient if the leaf spring 5 is depressed through the through hole 1*b* at the external band 1 by means of tweezers, screwdriver, etc. in order to separate the external band 1 from the internal band 2.

As described heretobefore, the watch case of this invention has a structure in which the lever 6 is inserted between the leaf spring 5 not protruding out of the periphery of the internal case band and the grooves 2*b*, 2*c* so as to press the leaf spring 5 outwardly and to be engaged with the long through hole 1*b* and thereby securing the internal case band 2 to the external case band 1. Therefore, it is very easy to assemble and disassemble the internal and external case bands. The leaf spring is not required to be bent during manufacture and the lever may be produced by press-manufacturing method only. Therefore, there can be obtained a waterproof watch case which is low in cost.

In the above embodiment, the engaging portion of the leaf spring is a through hole. However, this not essential and may be replaced by such a structure as a blind hole or groove for disengaging the leaf spring or a small through hole.

Figure 7:
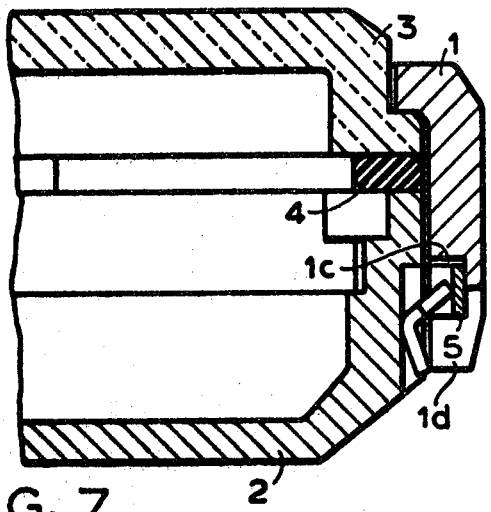
FIG. 7 is a partially vertical view showing a modified embodiment of a watch case of FIG. 3.
Figure 9:
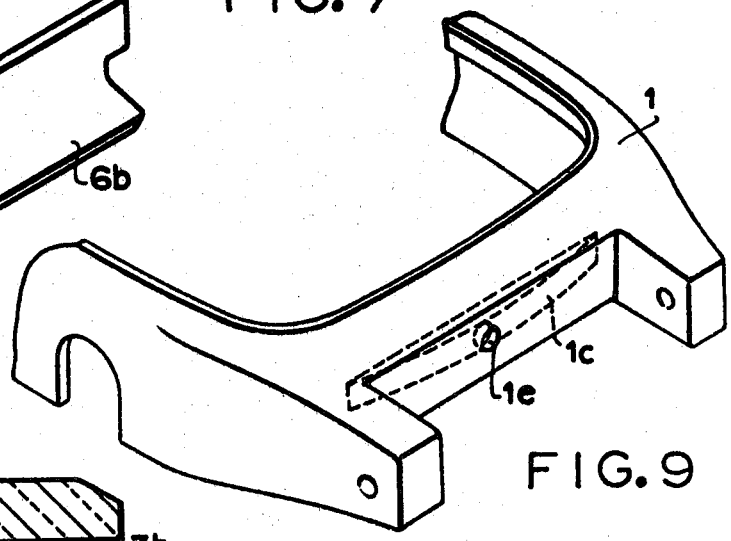
FIG. 9 is a partially perspective view showing another type external case band.
Figure 8:
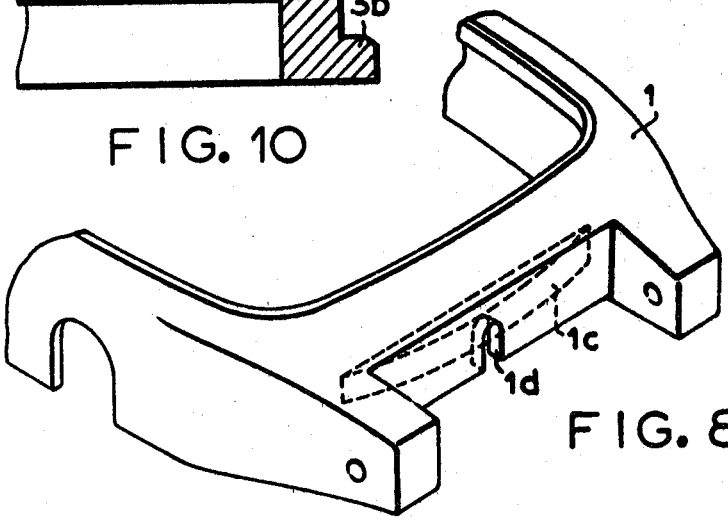
FIG. 8 is a partially perspective view showing an external case band of FIG. 7.

Namely, FIGS. 7, 8 and 9 show modified embodiments of a long through hole, from which it is clearly understood that the portion of the external case band 1 engaged with leaf spring 5 is not always required to be a through hole 1*b* as the first embodiment shown in FIG. 3.

In FIG. 7, a long blind bore 1*c* and cut-away portion 1*d* or hole 1*e* (FIG. 9) enable the engagement of the leaf spring 5. This long hole 1*c* is to be engaged with the leaf spring 5. The cutaway portion 1*d* or hole 1*e* is for compulsorily inserting the leaf spring 5 thereinto by means of such a tool as a pair of tweezers or screwdriver.

Figure 10:
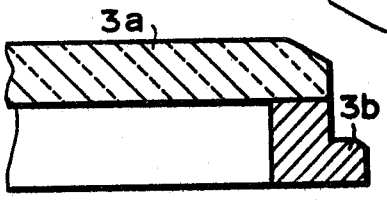
FIG. 10 is a partially vertical view showing a modified embodiment of a windshield.

Furthermore, the crystal may be a combination of a glass plate 3*a* and a glass ring 3*b*, e.g., by a bonding material as shown in FIG. 10.

While specific embodiments of the invention have been illustrated and described, it is to be understood that these embodiments are provided by way of example only and that the invention is not to be construed as being limited thereto, but only the proper scope of the following claims.

What is claimed is:

1. A watch case comprising:

a. an external case band having an inside wall, b. an internal case band having an outside wall, c. a crystal, d. a flexible packing sandwiched between the upper surface of said internal case band and the lower surface of said crystal, e. a horizontal groove formed on the outside wall of said internal case band, f. a leaf spring having an internal side fitted to to said horizontal groove, g. a vertical groove formed on the outside wall of said internal case band into which a lever is inserted, and h. a hole provided on the inside wall of said external case band through which said leaf spring is engaged, and wherein i. the operating point of said lever is within said vertical groove and on the internal side of said leaf spring.

2. A watch case as claimed in claim 10 wherein at least one end of said leaf spring is slidably mounted on said external case band by calking in press method.

3. A watch case as claimed in claim 1 wherein said crystal comprises a glass plate and a ring.

4. A watch case as claimed in claim 1 wherein an arm of said lever is arranged in said horizontal groove of said internal case band.

5. A watch case as claimed in claim 1 wherein a long blind hole is provided at the inside wall of said external case band for engagement with said leaf spring and a cutaway portion or hole is formed at the bottom of said long blind hole to compulsorily insert said leaf spring therein.

6. A watch case as claimed in claim 1 wherein a foot of said lever protrudes internally from the side wall of said internal case band when said foot is not engaged with said external case band.

7. A watch case as claimed in claim 1 wherein said lever is positioned internally from said side wall of said internal case band when said leaf spring is not engaged with said external case band.

8. A watch case as claimed in claim 1 wherein the lower surface portion of said external case band is engaged with said foot of said lever and thereby said leaf spring being compulsorily protruded at the upper portion of said lever.

* * * * *